US005405161A

United States Patent [19]

Petkov

[11] Patent Number: 5,405,161

[45] Date of Patent: Apr. 11, 1995

[54] ALPINE SKI WITH EXAGGERATED TIP AND TAIL

[75] Inventor: Ivan Petkov, Aspen, Colo.

[73] Assignee: Dennis Young, Aspen, Colo. ; a part interest

[21] Appl. No.: 191,633

[22] Filed: Feb. 4, 1994

[51] Int. Cl.[6] ..... A63C 5/04

[52] U.S. Cl. ..... 280/609

[58] Field of Search ..... 280/608, 609, 601, 602, 280/610

[56] References Cited

U.S. PATENT DOCUMENTS

| | | | |
|---|---|---|---|
| 3,360,277 | 12/1967 | Salvo et al. | 280/11.13 |
| 4,688,821 | 8/1987 | Meatto et al. | 280/609 |
| 4,715,612 | 12/1987 | Fels et al. | 280/609 |
| 4,995,631 | 2/1991 | Hunter | 280/607 |
| 5,096,217 | 3/1992 | Hunter | 280/607 |
| 5,230,527 | 7/1993 | Varan | 280/609 |
| 5,242,187 | 9/1993 | Diard et al. | 280/609 |
| 5,244,227 | 9/1993 | Lacroix | 280/609 |

FOREIGN PATENT DOCUMENTS

| | | |
|---|---|---|
| 149394 | 4/1937 | Austria . |
| 2559673 | 2/1985 | France . |
| 1132474 | 6/1962 | Germany . |
| 4112950 | 11/1991 | Germany . |
| 4205381 | 8/1992 | Germany . |

*Primary Examiner*—Richard M. Camby

*Attorney, Agent, or Firm*—Troutman Sanders; Joel S. Goldman; John A. Savio, III

[57] ABSTRACT

The present invention relates to ski having a tip portion, a tail portion and a waist portion between the tip portion and the tail portion. In accordance with the present invention, the ski has a wider tip and tail than do conventional skis. This widening of tip and tail are coupled with an exaggerated "side cut" or curvature of at least in the inside edge of the ski. A ski according the present invention has an exaggerated tip between 1.5 to 2.25 times the narrowest point of the waist and an exaggerated tail with a ratio of 1.05 to 2.14 times the narrowest point of the waist.

18 Claims, 1 Drawing Sheet

ALPINE SKI WITH EXAGGERATED TIP AND TAIL

BACKGROUND OF THE INVENTION

The present invention relates to snow skis and in particular to snow skis which are particularly adapted for downhill skiing which are known as "Alpine Skis."

Most of the designs for downhill Alpine Skis which are on the market today originated as designs for racing skis. These racing designs were "de-tuned" or softened to make them suitable for recreational skiers. Thus, most recreational skiers today must learn to ski and develop their skills on skis having shapes which are optimized for the skills of experts and racers.

One of the main purposes in designing a ski is to allow the skier to turn smoothly, naturally, with little effort, and with a feeling of stability at an enjoyable speed. To be able to turn while at the same time feeling "in control" is the goal of every skier at every ability level. However, with the exception of certain special purpose skis, most alpine skis have virtually the same shape and dimensions. The length of conventional alpine skis ranges from approximately 130 cm. to approximately 215 cm. with the particular length selected being primarily related to the size and weight of the skier. The width of the widest part of the front portion ("tip portion") of such a conventional ski is approximately 0.043 times the length or "chord" of the ski. The width of widest part of the rear ("tail portion") of the ski is approximately 0.038 times the chord. The middle or waist portion of the ski is typically slightly narrowed with respect to the tip and tail portions but conventionally the tip is no more than 1.2 to 1.35 times one of the waist portion of the ski and the waist portion is approximately 0.033 times the chord of the ski.

Given the rather standard shape of most conventional skis the focus of most efforts to obtain greater control for the skier have been in improving materials that the skis are made from and varying the flexibility of skis in accordance with snow conditions and the level of skill of the skier. For example, more flexible skis may be used on softer or powdery snow and stiffer skis on hard packed or icy conditions. Similarly, expert skiers have the ability to maintain control on stiffer skis and thereby gain more speed.

Several attempts have been made to design skis which are more easily controllable. For example, in U.S. Pat. No. 4,715,612 to Fels et al. a ski is described in which the tail portion is widened when compared with conventional skis and in which the ski boot is placed further back in the waist portion of the ski.

A French Patent No. 2559 673 to Cruciani sets forth a number of ski designs in which either the inside or outside edges of the ski or both have an exaggerated curvature which results in a comparative narrowing of the waist portion of the ski with respect to both its tip and tail and to its length or chord.

Neither of the above designs, nor any of the other prior art of which we are aware is known to produce the advantages which are obtained by the unique shape of the ski of the present invention.

It is an object of the present invention therefore to provide a ski which is easier to turn in all ski conditions then are present skis.

It is further object of the present invention to provide a ski which may be of a shorter length for a given body weight of the skier and given ski conditions then are optimum for present ski designs.

It is yet another object of the present invention to provide a ski design which may be more flexible then are conventional skis for a skier given body weight and level of skill.

SUMMARY OF THE INVENTION

In accordance with the present invention, a ski is provided which has a wider tip and tail than do conventional skis. This widening of tip and tail are coupled with an exaggerated "side cut" or curvature of at least in the inside edge of the ski. The wide tip leads the ski into a turn with very little edging motion. Consequently, little pressure is needed to initiate the turn. As the ski enters the turn, the side cut to the narrowed waist of the ski naturally creates the turning arc. Pressure may then be applied relatively effortlessly to a relatively soft wide tail portion of the ski and the turn is completed very smoothly.

The stability of conventional skis is primarily determined by the length especially at high speeds or over rough and uneven surfaces. Skis are made longer to provide more stability and hold a better line in turns. However, if stability can be accomplished otherwise, increased length is not required. Shorter skis have significant advantages over long skis in terms of quickness. Because of their shorter length and possibly lighter weight, they give the skier the ability to make tighter turns. As a result of the increased stability offered by the present ski design, it is possible to utilize a shorter ski while maintaining comparable stability. This also contributes to the maneuverability of the ski.

Test on prototypes of skis constructed in accordance with the present invention have proved them to quiet and stable in long turns at more than average speed. It was found that unlike traditional snow skis, the present skis constructed in accordance with the present invention appear to be relatively unaffected by differently sized chunks of snow.

It is believed that one of the reasons for the superior performance characteristics of the ski of the present invention is that its tip and tail portions both have a greater surface area and greater mass than corresponding portions of conventional skis. Consequently, skis in accordance with the present invention have a relatively greater total surface area in contact with the snow for any given edge angle. This increase in surface contact area provides greater stability. When the ski is put on edge, the greater tip and tail mass in combination with the exaggerated side cut, dig into the snow more effectively than conventional skis and allow easier initiation of a "carve" for the turn and there is far less tendency to slide. The greater capability of the ski to hold a carve in the turn gives the skier stability under his feet. In varying snow conditions, clumps of snow may have diameters ranging from a centimeter to several centimeters (e.g., "snake eggs," "death cookies," and "powder clumps"). Additionally, the surface may contain a hard crust top portion with a powder portion underneath, or may comprise powder having varying depths. Furthermore, a powder surface may be either soft or packed. The increased mass of the tip of the present invention appears to drive through the snow regardless of the snow condition with far less deflection than conventional skis providing the skier with far less forward and backward jerking.

A ski constructed in accordance with the present invention should have a tip portion with the maximum width which is between 1.5 and 2.25 times the minimum width of the waist portion of the ski. The ratio between the maximum width of the tail portion ski to the minimum width of the waist portion should be between 1.05 and 2.14. Finally, although it has been found that the skis in accordance with the present invention can be between 130 centimeters and 230 centimeters in length, presently preferred embodiments adult skis range from approximately 160 to 210 centimeters with the optimum length of ski depending on the skier's size and skiing ability.

The above and other objects and advantages of the present invention will be apparent from a reading of the specification and the appended claims in conjunction with the drawings wherein:

A BRIEF DESCRIPTION OF THE DRAWINGS

DETAILED DESCRIPTION

Figures 1, 2, 3, 4:
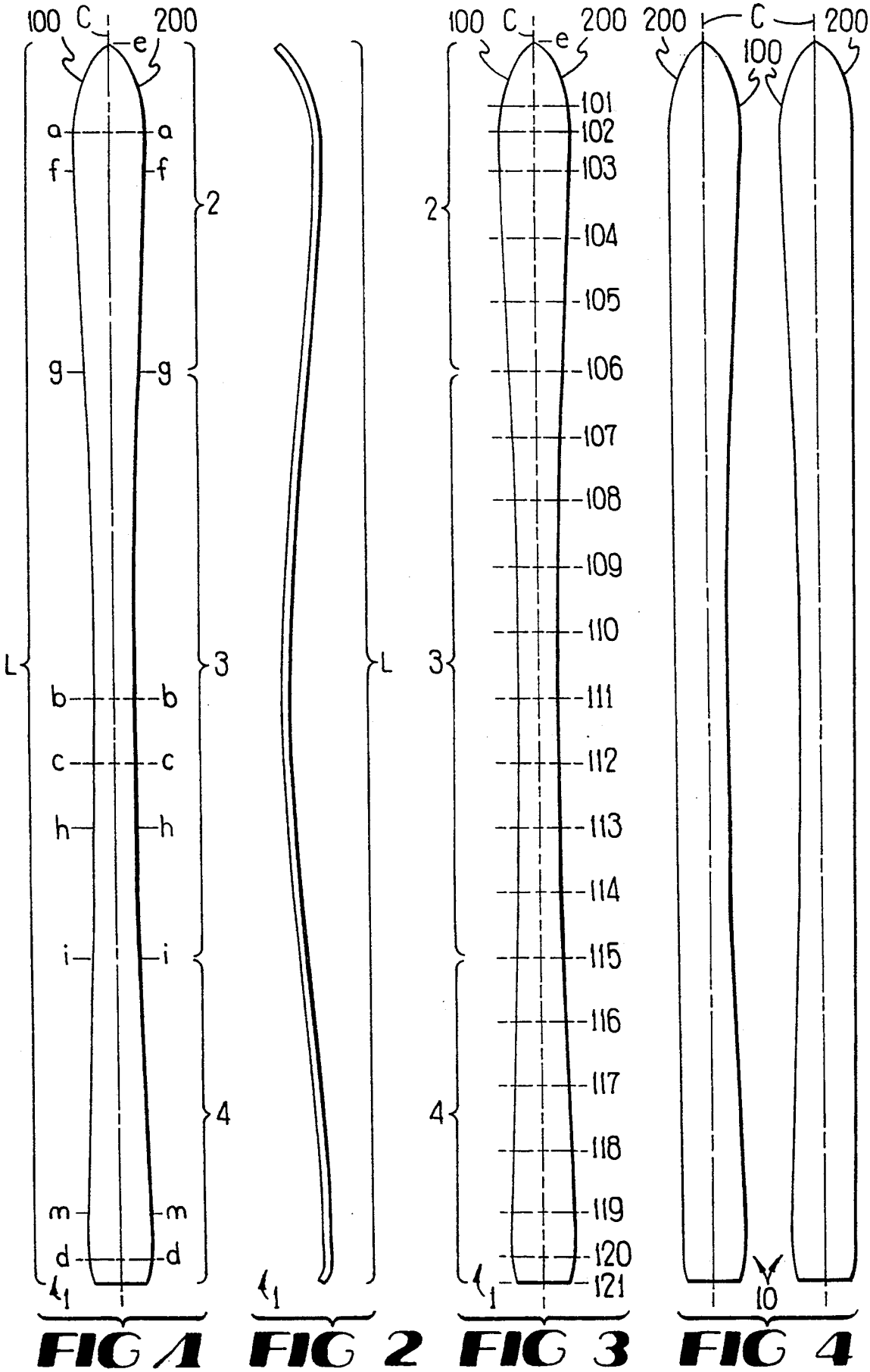
FIG. 1 is a top view of a ski in accordance the present invention showing portions of the ski in which critical dimensions are taken.
FIG. 2 is a side elevation of a ski in accordance with the present invention.
FIG. 3 is a top view of a presently preferred embodiment of a ski in accordance with the present invention.
FIG. 4 is a top view of a pair of skis in accordance with an alternative embodiment of the invention.

FIG. 1 is a top view of a ski 1 of the present invention showing the various portions of the ski as well as the points along the ski at which critical dimensions are taken. As illustrated in FIG. 1, the ski has a length L and may be deemed to have a center line or "chord" C. The chord is substantially parallel to a longitudinal axis of the ski. The ski may also be deemed to have three portions: a tip portion 2; a waist portion 3; and a tail portion 4.

The widest point of the tip portion of the ski, occurs at a point a. The narrowest point of the ski is at a point b which is within the waist portion 3 of the ski 1 preferably slightly behind the midpoint of the ski. Ski boots (not shown) may be attached to the ski so that the center of the boots will lie at a point c in the waist portions somewhat behind the narrowest point b of the ski. Finally, the widest point of the tail portion 4 of the ski occurs at a point d.

The ski 1 has an inside edge 100 and an outside edge 200 which, in preferred embodiments, are symmetrical so that different skis to not have to be manufactured for right and left feet. It is possible, however, for an edge of the ski contoured in accordance with the present invention to be only on the left edge 100 (or alternatively the right edge 200) of the ski (see FIG. 4). The contour of the inside edge 100 is, preferably a complex curve having convex and concave portions as set forth below. The edge 100 may include straight portions between convex and concave portions and may also have straight portions interrupting the concave or convex portions in one or more places.

In the embodiment of the invention illustrated in FIG. 1, the tip portion of the ski may be defined as extending from the tip e of the ski to the point g. A part of this tip portion extending from the tip e to a point f is convex in shape. A second part of the edge 100 in the tip portion extending from the point f to the point g is straight.

The waist portion 3 of the embodiment of the invention illustrated in FIG. 1 may be defined as extending from the point g to the point i. The edge 100 in this waist portion 3 includes a section between the point g and point b. Point b is the narrowest portion of the ski. A section of the edge 100 between the point b and a point h is straight and a section of the edge 100 between a point h and a point i is concave.

The tail portion 4 of the ski includes a section between the points i and a point m in which the edges 100 and 200 are straight and a section below the point m in which the edges 100 and 200 are convex.

The length of the ski may range between 130 and 240 centimeters in accordance with the present invention with a preferable range of 160 to 210 centimeters for most adults.

The performance advantages obtained by the invention derive from certain unique relationships between certain key dimensions of the ski of the present invention which are not found in previous skis. These relationships include an exaggerated width of the tip portion 2 of the ski with respect to both the width of waist portion 3 of the ski and the length L of the ski, and a relatively exaggerated relationship between the widest point a of the tail portion 4 and the narrowest part b of the waist portion 3 of the ski.

In accordance with the invention, the width at narrowest point of the ski b can range between 40 and 90 millimeters with a preferable range being between 55 and 70 millimeters. The ratio between the dimensions at widest part of the tip portion 2 at point a and the narrowest point of the ski at point b is of great importance. Preferably, the width of the tip portion at point a is between 1.5 and 2.25 times the width of the ski at point b with the higher ratios being generally applicable to skis at the longer end of the preferred range. A typical ratio between the width of the ski according to the present invention at point a to the width of the ski at point b is 1.8 to 1.

Another important relationship to be maintained in order to construct a ski in accordance with the present invention is a relationship between the width at widest point d of the tail portion 4 of the ski at point d to the narrowest point of the ski at point b. Preferably, the width at widest part d of the tail portion is between 1.05 and 2.14 times greater the width at the narrowest point b of the ski, with the higher ratios being applicable for longer skis. A typical ratio between the widest part d of the tail portion 4 and the narrowest point b of the waist 3 is 1.55 to 1.

Finally, the relationship between the widest dimension a of the tip portion 2 of the ski to the widest dimension d of the tail portion 4 of the ski is also an important part of the present invention. In accordance with the invention, the dimension of the widest part d of the tail portion should be between 70 to 95 percent of the dimensions of widest part a of the tip 2 with a preferable range being between 77% and 88%. Expressed in terms of ratios, the greatest width of the tip portion 2 of the ski at point a should preferably fall between 1.13 and 1.29 times the greatest width of the tail portion 4 at point d with a permissible range of between 1.05 and 1.43.

It has been found that when skis are constructed within the above guidelines it is possible to employ a ski which is five to twenty percent shorter for a skier of similar size, weight and abilities on comparable snow conditions. This shorter length also contributes to providing greater maneuverability regardless of snow conditions.

FIG. 2 illustrates a side view of the ski showing its camber or bowing of the waist portion of the ski. Although this bowing is comparable to similar bowing in conventional skis it is important that skis in accordance with the present invention have such a camber.

FIG. 3 illustrates a presently preferred embodiment of the present invention having a Length of 190.5. (It should be noted that this is horizontal dimension. Because of curvature of the ski as illustrated in FIG. 2 the actual length of the ski measured along its curved surface is 193 centimeters). In order to illustrate the contour of the complex edges 100 and 200 of the ski, measurements were taken of the width of the ski at the points indicated by the referenced numerals 101 through 121 and tabulated in Table 1 set forth below. Table 1 also shows the following ΔL—the distance (in centimeters) between the front tip of the ski and the referenced numeral in question;

ΔL/L;—ΔL divided by the total length L of the ski;

W—the width of the ski (in centimeters) at the point indicated by the reference numeral in question;

$W_C$—a distance (in centimeters) between the inside edge 100 of the ski and the chord or center line C at the referenced point in question;

$W_C/L$—the ratio between the length L of the ski and $W_C$ at the point in question;

W/L—the ratio between the length L of the ski and W at the point in question.

TABLE 1

| REF. NUM. | ΔL | $\frac{\Delta L}{L}$ | W | $W_c = \frac{W}{2}$ | $\frac{W_c}{L} \times 10^2$ | $\frac{W}{L} \times 10^2$ |
|---|---|---|---|---|---|---|
| 101 | 10 | .052 | 10.8 | 5.4 | 2.83 | 5.67 |
| 102 | 14 | .073 | 11.0 | 5.5 | 2.89 | 5.77 |
| 103 | 20 | .105 | 10.6 | 5.3 | 2.78 | 5.56 |
| 104 | 30 | .157 | 9.8 | 4.9 | 2.57 | 5.14 |
| 105 | 40 | .210 | 9.0 | 4.5 | 2.36 | 4.72 |
| 106 | 50 | .262 | 8.2 | 4.1 | 2.15 | 4.30 |
| 107 | 60 | .315 | 7.5 | 3.75 | 1.97 | 3.94 |
| 108 | 70 | .367 | 7.0 | 3.5 | 1.84 | 3.67 |
| 109 | 80 | .420 | 6.6 | 3.3 | 1.73 | 3.46 |
| 110 | 90 | .472 | 6.3 | 3.15 | 1.65 | 3.30 |
| 111 | 110 | .525 | 6.2 | 3.1 | 1.63 | 3.25 |
| 112 | 110 | .577 | 6.3 | 3.15 | 1.65 | 3.30 |
| 113 | 120 | .630 | 6.4 | 3.2 | 1.68 | 3.36 |
| 114 | 130 | .682 | 6.6 | 3.3 | 1.73 | 3.46 |
| 115 | 140 | .735 | 7.1 | 3.55 | 1.86 | 3.73 |
| 116 | 150 | .787 | 7.7 | 3.85 | 2.02 | 4.04 |
| 117 | 160 | .840 | 8.3 | 4.15 | 2.8 | 4.36 |
| 118 | 170 | .892 | 8.9 | 4.45 | 2.34 | 4.67 |
| 119 | 180 | .945 | 9.5 | 4.75 | 2.49 | 4.99 |
| 120 | 186.8 | .981 | 9.6 | 4.8 | 2.51 | 5.04 |
| 121 | 190.5 | 1.0 | 8.9 | 4.45 | 2.34 | 4.67 |

The $W_C$ dimension is important because in embodiments of the invention such as illustrated in FIG. 4 skis 10 are shown where the distance from the inside edge 100 of the ski to the chord c is not equal to the distance from outside edge 200 to the chord c it is the inside width dimension $W_C$ which is used in constructing a ski in accordance with the present dimensions.

The normalized width dimensions ($W_C/L$ and W/L) can be used to construct longer and shorter skis with the same dimensional relationships as the 190.5 centimeter ski illustrated in FIG. 3. It will be appreciated, however, that the ranges of and relationships between the tail, waist and tip dimensions may be varied within the ranges set forth above without departing from the scope of the invention.

While principles of the present invention have been described above in conjunction with specific embodiments, it is to be clearly understood that this description is made only by way of example and not as a limitation to the scope of the invention which is defined by the appended claim.

What is claimed is:

1. A ski comprising:

a tip portion;

a tail portion including a back edge;

a waist portion between said tip portion and said tail portion wherein the maximum width of the tip portion is greater than 1.5 times the minimum width of said waist portion and greater than 1.05 times the maximum width of said tail portion; and inside and outside edges originating at an apex of said tip portion and terminating at said back edge, wherein at least one edge comprises a complex curve including;

a first straight portion between said tip portion and said waist portion, wherein said first straight portion tapers toward a longitudinal axis of said ski near said waist, and a second straight portion between said waist portion and said tail portion, wherein said second straight portion tapers toward said longitudinal axis near said waist portion.

2. A ski in accordance with claim 1 wherein the maximum width of said tip portion is less than 2.25 times the minimum width of said waist portion.

3. A ski in accordance with claim 2 wherein the maximum width of said tip portion is approximately 1.8 times the minimum width of said waist portion.

4. A ski in accordance with claim 1 wherein the maximum width of said tip portion is less than 1.43 times the maximum width of said tail portion.

5. A ski in accordance with claim 4 wherein the maximum width of said tip portion is approximately 1.2 times the maximum width of said tail portion.

6. A ski in accordance with claim 1 wherein the maximum width of said tail portion is more than 1.05 times greater than the minimum width of said waist portion.

7. A ski in accordance with claim 6 wherein the maximum width of said tail portion is less than 2.14 times the minimum width of said waist portion.

8. A ski in accordance with claim 7 wherein the maximum width of said tail portion is approximately 1.25 times the minimum width of said waist portion.

9. A ski comprising a tip portion including a front tip;

a tail portion including a back edge;

a waist portion between said tip portion and said tail portion;

a chord defined by a line running between said front tip portion to said back edge, said chord being approximately parallel to a longitudinal axis of said ski; and an inside edge extending from an apex of said tip portion to an inside end of said back edge comprising a complex curve including;

a first straight portion between said tip portion and said waist portion, wherein said first straight portion tapers toward a longitudinal axis of said ski near said waist, and a second straight portion between said waist portion and said tail portion, wherein said second straight portion tapers toward said longitudinal axis near said waist portion;

wherein the maximum perpendicular distance from said inside edge to said chord within said tip portion is greater than 1.5 times the minimum perpendicular distance between said inside edge and said chord within said waist portion and more than 1.05 times the maximum distance between said inside edge and said chord within said tail portion.

10. A ski in accordance with claim 9 wherein the maximum perpendicular distance from said chord to said inside edge within said tip portion is less than 2.25 times the minimum width of said waist portion.

11. A ski in accordance with claim 10 wherein the maximum perpendicular distance from said chord to said inside edge within said tip portion is approximately 1.8 times the minimum width of said waist portion.

12. A ski in accordance with claim 9 wherein the maximum perpendicular distance from said chord to said inside edge within said tip portion is less than 1.43 times the maximum width of said tail portion.

13. A ski in accordance with claim 12 wherein the maximum perpendicular distance from said chord to said inside edge within said tip portion is approximately 1.2 times the maximum width of said tail portion.

14. A ski in accordance with claim 9 wherein the maximum perpendicular distance from said chord to said inside edge within said tail portion is more than 1.05 times greater than the minimum width of said waist portion.

15. A ski in accordance with claim 14 wherein the maximum perpendicular distance from said chord to said inside edge within said tail portion is less than 2.14 times the minimum width of said waist portion.

16. A ski in accordance with claim 15 wherein the maximum perpendicular distance from said chord to said inside edge within said tail portion is approximately 1.25 times the minimum width of said waist portion.

17. A ski in accordance with claim 1 wherein said complex curve further includes:

a first convex portion extending from said tip apex to a middle portion of said tip portion, said first straight portion extending from said middle tip portion to a forward portion of said waist portion, a first concave portion extending from said forward waist portion to a middle portion of said waist, a second concave portion extending from a rear portion of said waist portion to a forward portion of said tail portion, said second straight portion extending from said forward tail portion to a middle portion of said tail, and a second convex portion extending from said middle tail portion to said back edge.

18. A ski in accordance with claim 9 wherein said complex curve further includes:

a first convex portion extending from said tip apex to a middle portion of said tip portion, said first straight portion extending from said middle tip portion to a forward portion of said waist portion, a first concave portion extending from said forward waist portion to a middle portion of said waist portion, a second concave portion extending from a rear portion of said waist portion to a forward portion of said tail portion, a second straight portion extending from said forward tail portion to a middle portion of said tail portion, and a second convex portion extending from said middle tail portion to said back edge.

* * * * *